US005127328A

United States Patent [19]

Wieland

[11] Patent Number: 5,127,328

[45] Date of Patent: Jul. 7, 1992

[54] METHOD AND APPARATUS FOR AUTOMATICALLY FEEDING A PRINTING PLATE

[75] Inventor: Erich G. Wieland, Wurzburg, Fed. Rep. of Germany

[73] Assignee: Koenig & Bauer Aktiengesellschaft, Wurzburg, Fed. Rep. of Germany

[21] Appl. No.: 622,017

[22] Filed: Dec. 4, 1990

[30] Foreign Application Priority Data

Dec. 9, 1989 [DE] Fed. Rep. of Germany ..... 3940795

[51] Int. Cl.[5] ..... B41F 27/06; B41L 29/16

[52] U.S. Cl. ..... 101/415.1; 101/477; 101/483

[58] Field of Search ..... 101/141-144, 101/132.5, 415.1, 409-441, 233, 234, 216, 132, 136, 232, 483, 137, 138, 477, 485, 486; 271/258, 259, 265

[56] References Cited

U.S. PATENT DOCUMENTS 3,793,950 2/1974 Kaneko et al. ..... 101/130 X
3,874,290 4/1975 Suzuki ..... 101/132.5
3,903,795 9/1975 Suzuki ..... 101/409
4,858,528 8/1989 Inouye et al. ..... 101/415.1

FOREIGN PATENT DOCUMENTS 0268857 6/1988 European Pat. Off. .
1118807 12/1961 Fed. Rep. of Germany .
2330947 5/1976 Fed. Rep. of Germany .
3604071 8/1987 Fed. Rep. of Germany .
3626936 2/1988 Fed. Rep. of Germany .

*Primary Examiner*—J. Reed Fisher
*Attorney, Agent, or Firm*—Jones, Tullar & Cooper

[57] ABSTRACT

A method and apparatus for automatically feeding a printing plate to, or receiving a printing plate from, a printing plate cylinder in a rotary printing machine utilizes a plate storage compartment which is situated adjacent the plate cylinder. Several transport rolls are located between the storage compartment and the plate cylinder. A control computer is used to automatically actuate the transfer rolls, a drive for the plate cylinder and plate clamping and tensioning assemblies on the plate cylinder.

11 Claims, 7 Drawing Sheets

METHOD AND APPARATUS FOR AUTOMATICALLY FEEDING A PRINTING PLATE

FIELD OF THE INVENTION

The present invention is directed generally to a method and apparatus for automatically feeding a printing plate. More particularly, the present invention is directed to a method and apparatus for automatically feeding a printing plate to, or receiving a printing plate from a printing plate cylinder. Most specifically, the present invention is directed to a method and apparatus for automatically feeding a printing plate to, or receiving a printing plate from a printing plate cylinder of a rotary printing machine. A printing plate feeding and receiving assembly, which includes a printing plate feeding and receiving chamber, is situated adjacent a plate cylinder of a printing unit. The plate cylinder has suitable plate end clamping assemblies and several transport rolls are used to feed a printing plate from the chamber or to return a printing plate to the printing plate feeding and receiving chamber.

DESCRIPTION OF THE PRIOR ART

In rotary printing machines, a flexible printing plate is secured to the outer peripheral surface of a plate cylinder. This has typically been done manually by stopping the plate cylinder, manually actuating various printing plate leading and trailing end clamps, removing one printing plate, and putting a replacement plate on. Whenever such a series of steps are done manually, there is a significant possibility that the operating personnel may be injured or, alternatively, that the printing plate will be attached to the plate cylinder out of register so that time-consuming plate adjustments will be needed to put the plate in its proper position on the plate cylinder.

In an effort to overcome the drawbacks of the prior manual plate attachment and removal procedures, various semi-automatic printing plate feeding and receiving assemblies have been utilized. One such semi-automatic printing plate feeding and receiving device is shown in European patent application No. 0268857. This assembly is usable to fasten a printing plate onto the surface of a plate cylinder of a rotary printing machine.

In the semi-automatic device shown in the above-identified patent application, it is necessary for the printing plate to be fed by hand into the plate clamping device. It is further necessary that the commands to feed in the plate as well as to clamp and tension the plate have to be manually accomplished on a control desk. Thus while this semi-automatic device is better than the prior art completely manual procedure, it still requires some manual operation and the attention of a skilled operator.

It will thus be apparent that a need exists for a fully automatic method and apparatus for feeding a printing plate to a plate cylinder and for receiving a printing plate from a plate cylinder. The method and apparatus in accordance with the present invention provides such a device and is a substantial improvement over the prior art devices and procedures.

SUMMARY OF THE INVENTION

It is an object of the present invention to provide a method and apparatus for automatically feeding a printing plate.

Another object of the present invention is to provide a method and apparatus for automatically feeding a printing plate to, or receiving a printing plate from a printing plate cylinder.

A further object of the present invention is to provide a method and apparatus for automatically feeding a printing plate to, or receiving a printing plate from a printing plate cylinder of a rotary printing machine.

Still another object of the present invention is to provide a method and apparatus for feeding in or feeding out a plate cylinder to or from a plate cylinder and to provide a plate storage chamber.

Yet a further object of the present invention is to provide a method and apparatus for feeding a printing plate to, or receiving a printing plate from a plate cylinder utilizing automatic controls.

As will be presented in greater detail in the description of the preferred embodiment which is set forth subsequently, the method and apparatus for automatically feeding a printing plate in accordance with the present invention utilizes a printing plate storage chamber which is situated adjacent the plate cylinder. Several transport rolls are placed intermediate an end of the chamber and the plate cylinder. A printing plate to be fed to or removed from the plate cylinder is received in the storage chamber and is directed to or from the plate cylinder through several transport rolls. The operation of these transport rolls, as well as the operation of the plate cylinder clamps and plate tensioning device are controlled automatically by a suitable control computer in accordance with a logic diagram or flow chart.

The method and apparatus for automatically feeding a printing plate in accordance with the present invention allows auxiliary staff personnel to place a printing plate in or remove a printing plate from the plate storage or receiving chamber. A skilled operator is not required for this procedure and there is no possibility that the auxiliary staff will come into contact with the plate cylinder or the other associated cylinders of the printing unit. Thus, staff safety is substantially increased by the present invention.

Since the feeding of the printing plate to or from the plate cylinder is done in a completely automatic manner, the speed and accuracy of the plate feedings are increased. An increase in the speed of plate feeding or removal means less stoppage of the printing press and thus increased press production. An improvement in the accuracy of the printing plate placement provides better registry of the plate. This improved plate registry reduces printing waste since less time and less paper will be wasted in effecting register correction.

The method and apparatus for automatic printing plate feeding in accordance with the present invention overcomes the limitations of the prior art method and procedures. The present invention thus is a significant advance in the art.

BRIEF DESCRIPTION OF THE DRAWINGS

While the novel features of the method and apparatus for automatically feeding a printing plate in accordance with the present invention are set forth with particularity in the appended claims, a full and complete understanding of the invention may be had by referring to the detailed description of the preferred embodiment which is set forth subsequently, and as illustrated in the accompanying drawings, in which

DETAILED DESCRIPTION OF THE PREFERRED EMBODIMENT

Figure 1:
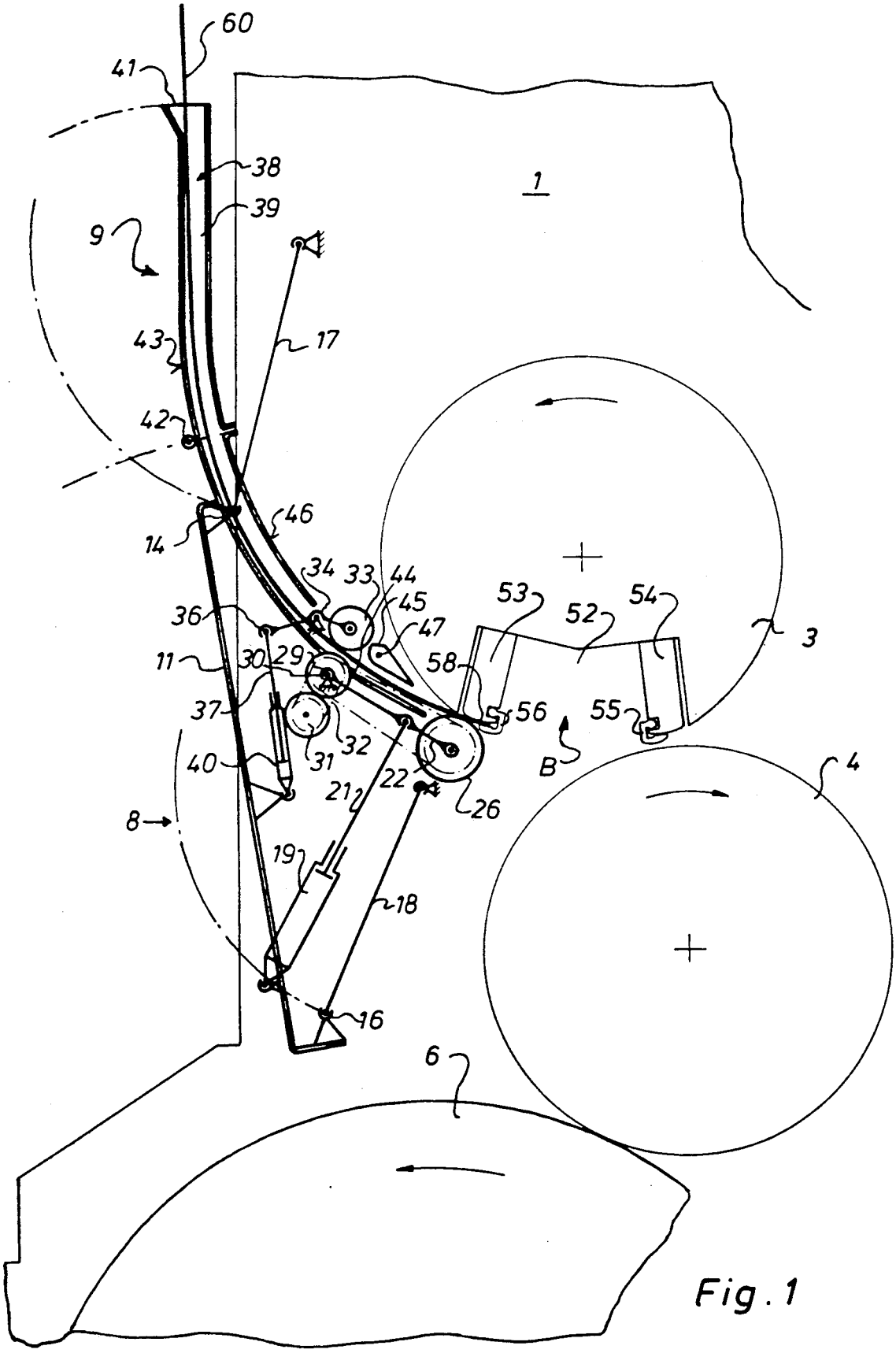
FIG. 1 is a side elevation view, partly in section of a portion of a rotary printing unit and showing the present invention in a printing plate feeding in position.

Referring initially to FIG. 1, there may be seen generally at 1 a generally conventional rotary printing unit 1. This unit 1 includes, among other things not specifically shown, a plate cylinder 3, a blanket cylinder 4 and an impression cylinder 6. These various cylinders are rotatably supported in side frames (not specifically shown) of the rotary printing machine. Typically, multiple such printing units 1, such as four or more such units, are assembled to form a rotary printing machine. Since each of these printing units 1 is essentially the same as each other unit, the invention will be discussed with reference to only one such unit 1.

Figure 2:
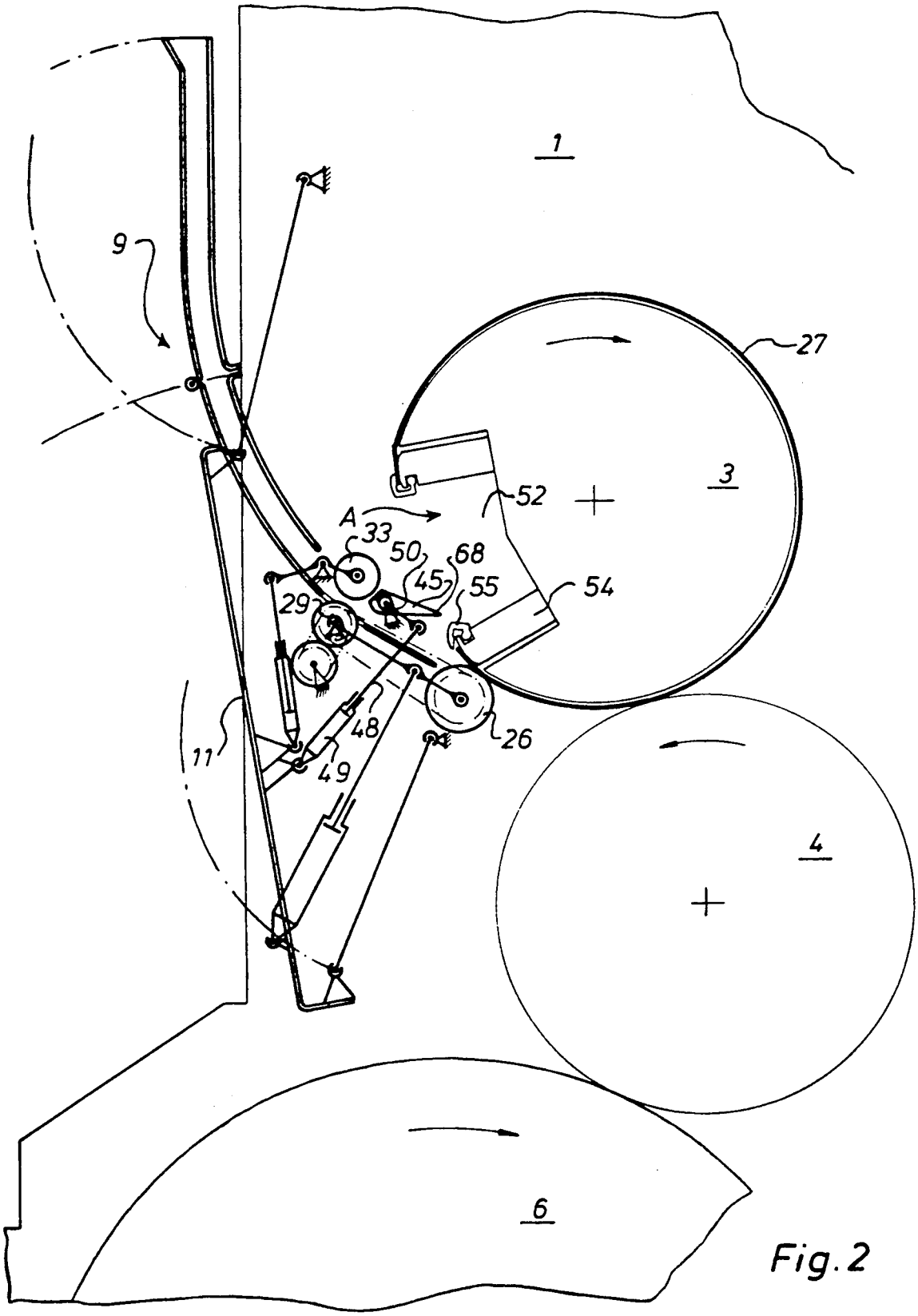
FIG. 2 is a side elevation view, generally similar to FIG. 1 and showing the assembly in a printing plate releasing position.

Again referring to FIG. 1 and also to FIG. 2, a printing plate feeding in and feeding out assembly generally at 9, in accordance with the present invention is located adjacent the cylinders 3, 4, and 6 on an operation or access side 8 of the printing unit 1. A cover plate 11 is associated with the printing plate feeding and receiving assembly 9. The cover plate 11 is generally in the form of a rectangular plate and is attached at its upper and lower ends to first ends of upper and lower swinging arms 17 and 18, respectively. Second ends of these upper and lower swinging arms 17 and 18 are pivotably secured to the side frames of the printing unit 1. The travel radii of the first ends of the swinging arms 17 and 18 are depicted by dot-dash lines in FIGS. 1 and 2. To allow this double swinging movement of the cover plate 11 on the swinging arms 17 and 18 there are provided upper and lower pivot joints 14 and 16 on the upper and lower inner surfaces of the cover plate. The first ends of the swinging arms 17 and 18 are received in these pivot joints 14 and 16. The cover 11 can thus be viewed as a connecting rod, with the swinging arms 17 and 18 and the frame of the printing unit effectively cooperating to form a connecting bar and the assembly thus forming a hinged rectangle. This allows the cover plate 11 to be moved about the two swinging or pivot radii to afford access to the underlying rollers and mechanisms as will be discussed subsequently.

A double acting hydraulic or pneumatic cylinder 19 is secured on both lower side of the cover plate 11 generally adjacent its lower end. A piston rod 21 of each double acting cylinder 19 is hingedly secured to a lever 22 intermediate the ends of each lever 22. A passing feed roller 26 is supported for rotation between first ends of the spaced levers 22. The axis of rotation of this passing feed roller 26 is parallel to the axis of rotation of the plate cylinder 3. The feed roller 26 may also be recessed. The surface of feed roller 26 is provided as a relatively soft material, such as a rubber or synthetic material which is softer than a printing plate 27 or 60 which will be carried by plate cylinder 3.

A driving reel 29 is supported for rotation about an axis 30 which is rotatably supported in the side frames of the cover plate 11. Second ends of the spaced levers 22 are rotatably supported about the axis 30 of the driving reel 29. The driving reel 29 is recessed and has a drive assembly, such as a geared drive, an electromotor, or the like. In the preferred embodiment, as depicted in FIGS. 1 and 2, the drive of reel 29 is accomplished by a sprocket wheel 31 and a drive chain 32. As may also be seen in FIGS. 1 and 2, the feed roller 26 and the driving reel 29 are also connected by a drive chain so that they preferably have the same peripheral speed of rotation.

A press-on roller 33 is positioned for relative engagement with the surface of driving reel 29. This press-on roller 33 is rotatably supported between first ends of a double armed lever 34. This double armed lever 34 is pivotably supported generally in the middle of the side frames of the cover plate 11 and has a joint 36 on its second end. This joint 36 is connected to a free end of a piston rod 37 which is a portion of a double-acting cylinder 40. This cylinder 40 is hingedly connected to the inner surface of the cover plate 11.

Again, as may be seen in FIGS. 1 and 2, the printing plate feeding and receiving device, generally at 9, consists of a container generally at 38 which is generally the same width as the plate cylinder 3. This container 38 forms a storage compartment, generally at 39, for a printing plate 27 or 60 to be fed to or received from the plate cylinder 3. In cross-sectional shape, the upper part of container 38 is generally vertical while a lower part curves toward, and is generally tangential to, the surface of plate cylinder 3. A somewhat funnel shaped opening 41 is provided at the upper end of container 38 to make feeding of a printing plate 27 or 60 into the storage chamber 39 easier. The upper portion of the storage container 38 is hingedly attached to the lower portion of container 38 by a hinge 42. This hinge 42 is located above the upper edge of cover plate 11. This two-part structure allows the upper portion of the storage container 38 to be pivoted down and to the left, as seen in FIG. 1, so that access may be had to an upper part of the printing unit 1. This will allow an operating person to have access to various printing unit equipment, such as an inking unit or the like (not specifically shown) which may be located behind the upper portion of the storage container 38.

A front wall 43 of the storage container 38 extends to generally the location of the feed roller 26. This front wall has spaced openings 44 in the area of the driving reel 29 so that the surface portion of the driving reel 29 projects into the storage chamber 39. A back wall 46 of the storage container 38 extends downwardly nearly to the press-on roll 33.

Several lifting fingers 45 are located between press-on roll 33 and the surface of the plate cylinder 3. These lifting fingers 45 are arranged generally parallel to the front wall 43 and are carried by a rotatable lifting finger shaft 47 which is secured for rotation on the side frame of the cover plate 11. A driving means for the lifting finger shaft 47 is shown in FIG. 2. As may be seen there, a lever arm 50 is connected at a free end to a piston rod 48. This lifting finger piston rod 48 is part of a double acting cylinder 49 that is also hinged to the cover plate 11. The lifting fingers 45 are pivotably supported by the shaft 48 and the lever arm 50 so that extension and retraction of the piston rod 48 will move peaks 68 of the lifting fingers 45 into the periphery 62 of the plate apparatus 3 or clear of the periphery 62 of the plate cylinder, as may be seen in FIGS. 2 and 1, respectively. It will be understood that the assembly is provided with suitable means (not specifically shown) which will allow the peaks 68 of the lifting fingers 45 to move into the periphery 62 of the plate cylinder 3 only in the area of a plate cylinder groove 52, as is depicted in FIG. 2. This ensures that the lifting finger peaks 68 cannot be damaged by contact with the surface 62 of the plate cylinder 3 and also cannot contact a printing plate 27 or 60 which may be secured to the surface of the plate cylinder 3.

The plate cylinder 3 is provided with plate clamping and tensioning devices 53 and 54 which are located at opposing ends of the groove 52 formed in the plate cylinder 3. These plate clamping and tensioning devices 53 and 54 are generally known and are disclosed in German patent specification No. 36 26936. These plate clamping and tensioning devices 53 and 54 are characterized by the placement of a pivotably carried clamping bar 55 and 56 which may be seen most clearly in FIGS. 3 and 4. A printing plate end 57 which is to be fed to, or taken out of the plate clamping device, generally at 54, is not obstructed by the clamping bar 55. The tensioning assembly which is usable to tension the printing plate 27 or 60 that is secured to the printing plate cylinder 3 by the two plate clamping and tensioning devices 53 and 54, is also generally known in the art, as may be seen in German published unexamined patent application No. 36 94071. Thus, while both these plate clamping and tensioning devices are used in the present invention, their specific structures do not form part of the invention.

The plate clamping and tensioning devices 53 and 54 are provided with suitable adjusting and operating elements which are not specifically shown. These may be provided with an operating medium, such as hydraulic fluid, compressed air, or the like, through suitable rotating torque lead-ins on the plate cylinder's axis. It is also possible to provide devices which will supply this operating medium to the plate cylinder 3 while the cylinder is stopped in one of three positions A, B, or C which will be discussed shortly. This operating medium can be supplied to the side or periphery of the plate cylinder. The adjusting elements for the plate clamping and tensioning devices 53 and 54 may be operated hydraulically, pneumatically, mechanically, or even electrically.

During operation of the printing unit in its normal printing cycle, the printing plate feeding in or feeding out device 9 of the present invention is in a position as is shown in FIG. 1. In this position, any access to cylinders 3, 4, or 6 is precluded by the cover plate 11 which is located as shown in FIGS. 1 and 2. During normal print operation, the feed roller 26 is moved off the surface of the plate cylinder 3. If desired, the cover plate may have a means for allowing visual observation of the plate cylinder 3.

Figure 3:
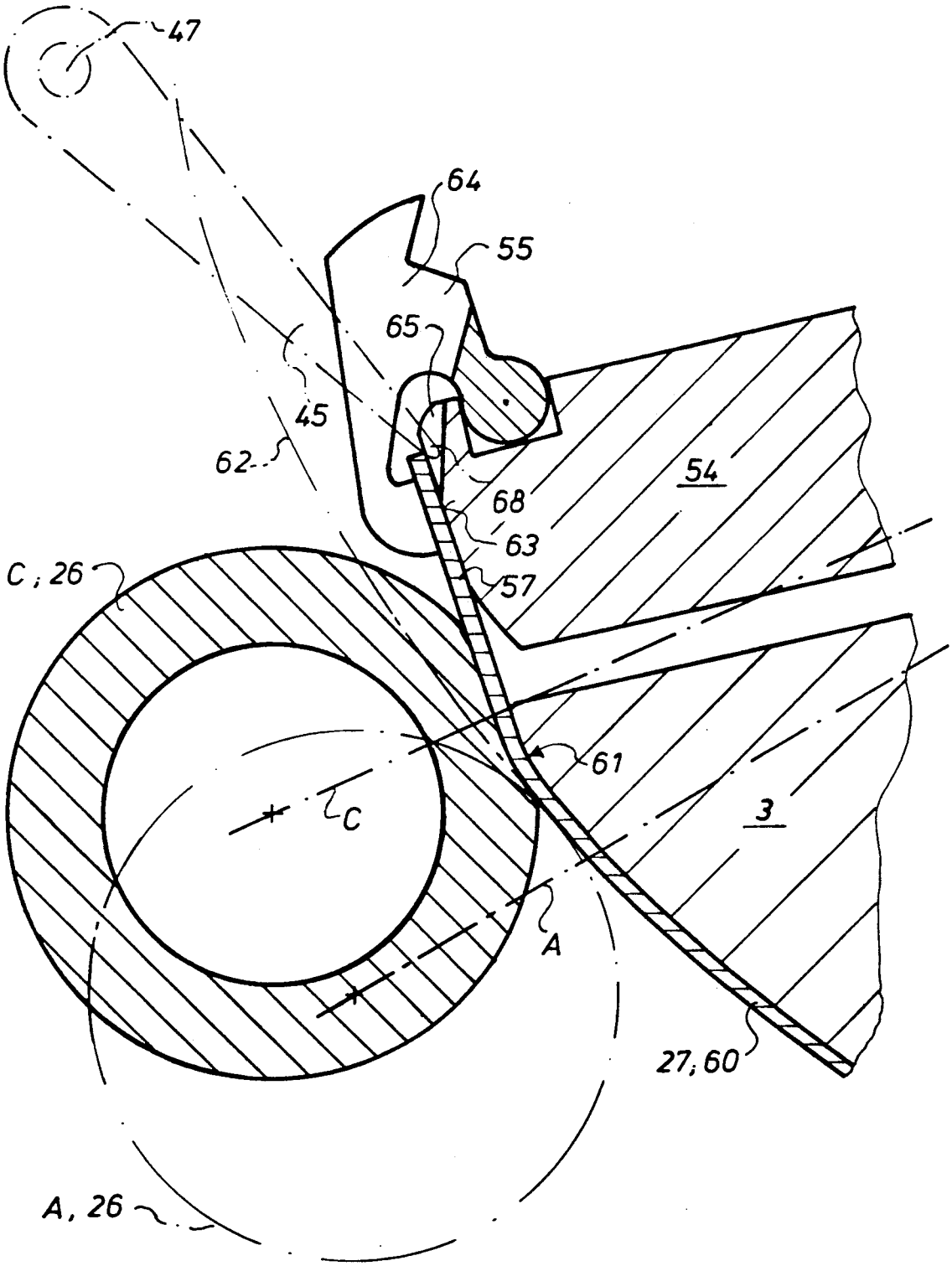
FIG. 3 is an enlarged side elevation view of a portion of the printing plate cylinder and showing a plate trailing end clamping assembly in a plate clamping position.

Upon completion of the running printing order, the plate cylinder is run to a pre-selected angular position A, as is shown in FIGS. 2 and 3. Once this angular position has been reached, the printing plate trailing end clamping assembly 54 is actuated to open the clamping bars 55. The trailing end 57 of the printing plate 27 or 60 to be removed, will spring away slightly from the surface of the plate cylinder 3 due to its own elastic natural tension. The trailing end 57 of the printing plate being removed will either move by itself into engagement with the lower end of the front wall 43 of the storage container 38 or will be placed there by the lifting fingers 45.

After the plate trailing end clamp bar 55 has opened, the plate cylinder 3 will be rotated clockwise from initial position A to a second position C. As the plate cylinder 3 is rotated from the printing plate releasing position A clockwise or backwards into the position C, the double acting cylinder 49 is provided with working fluid. This will extend the peaks 68 of the fingers 45 through spaced apertures 64 in the clamping bar 55, as may be seen more clearly in FIG. 3. The peaks 68 of the fingers 45 will be received in recesses 65 in the plate clamping and tensioning device 54 and will be guided beneath the trailing end 57 of the printing plate 27 or 60. These fingers 45 will thus effect a lifting of the plate end 57 away from the clamping abutment surface 63. At the same time that the plate cylinder is rotated from position A to position C, as shown in FIG. 3, the feed roller 26 is moved into engagement with the surface of the printing plate carried on the plate cylinder 3.

Figure 4:
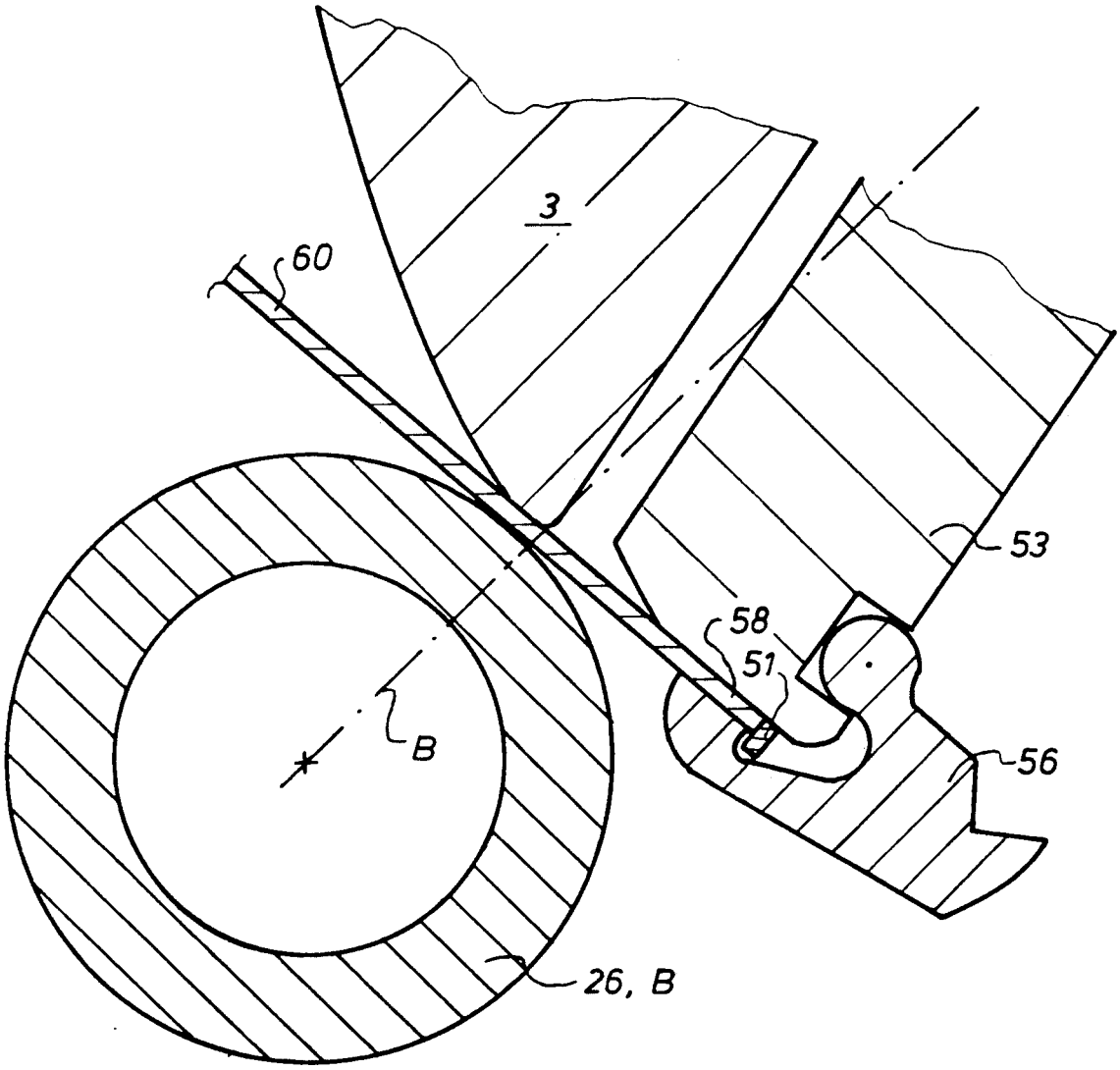
FIG. 4 is an enlarged side elevation view of a portion of the printing plate cylinder and showing a plate leading end clamping assembly in a plate clamping position.

Continued rotation of the plate cylinder 3 in a clockwise direction, in connection with the driven feed roller 26, will now effect the feeding out of the trailing end 57 of the printing plate 27 from the plate cylinder 3 and the feeding in of the printing plate 27 into the storage compartment 39. During this process, the end 57 of the printing plate will be moved into a gap between the transport rollers which consist of driving reel 29, and press-on roll 33. The transport rollers will now grasp the ends 57 of the printing plate and will continue to transport the printing plate 27 with the same or even a greater peripheral speed as the plate cylinder 3 does, with this same speed being possible if the clamping bar 56 of the plate clamping and plate tensioning device 53 for the beginning 58 of the printing plate is in the angular position B of the plate cylinder, as seen in FIGS. 1 and 4. Increased speed for the plate is possible if clamp 56 has been opened. The printing plate 27 will be transported by the transport rollers 29 and 33 until the printing plate end 58 of the printing plate 27 has left the gap between the rollers, which means until the printing plate end 58 is transported out of the lower part of the printing plate feeding in and feeding out device 9. An operating person will now be able to grip the printing plate end 57 and to take the printing plate 27 out of the storage compartment 39 of the storage container 38.

To accomplish the equipment of the plate cylinder 3 with a new printing plate 60, an operating person will put the new printing plate 60 into the storage container 39, leading end first, until it contacts the transport rollers 29 and 33. The plate cylinder 3 will be in the plate cylinder feeding in position, shown in FIGS. 1 and 4, and the clamping bar 56 is open. Now the transport rollers 29 and 33 are activated and will transport the new printing plate 60 out of the storage compartment 39, until the leading end 58 of the printing plate contacts a stop 51 of the printing plate clamping and tensioning device 53, as may be seen in FIG. 4.

Figure 5:
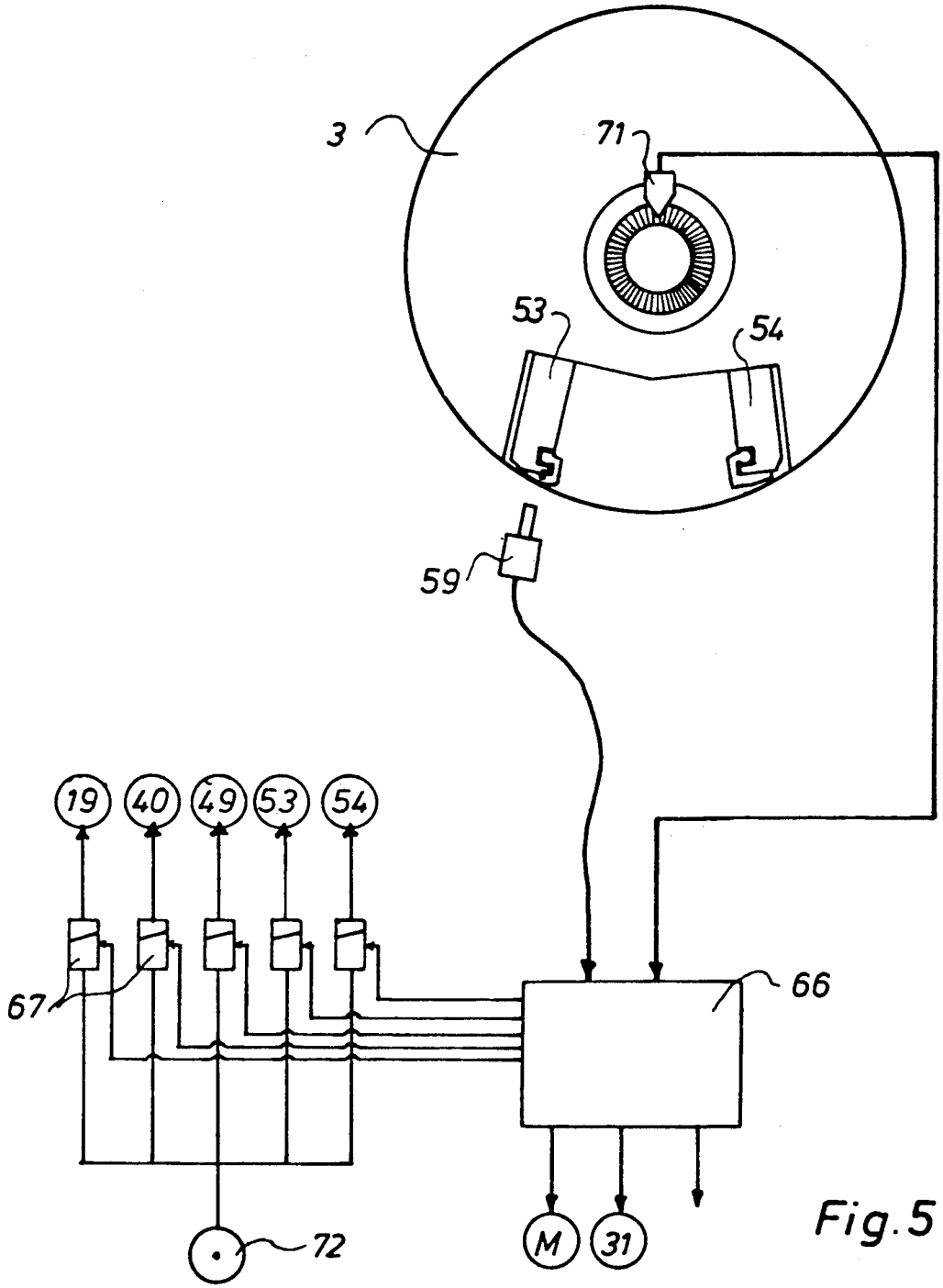
FIG. 5 is a schematic view of a control device and control computer of the present invention.

A position detector 59 for the contact of the printing plate 27 or 60 on the stop 51, as seen in FIG. 5, will give a "good" signal to a control computer 66, whereupon the clamping bar 56 will be closed. If the position detector 59 signals a bad feeding in of the printing plate 60 to the stop 51 of the plate clamping device 54, the printing plate clamping process will be interrupted and a fault signal will be produced. The beginning 58 of the printing plate is now clamped. The plate cylinder 3 will now be rotated counter-clockwise, or forwardly, while the feed roller 26 presses the printing plate 60 against the plate cylinder 3. The plate cylinder 3 will continue to be rotated forwardly until the plate cylinder 3 is again in position C, as shown in FIG. 3. At this point, the trailing end 57 of the printing plate 60 being fed onto the plate cylinder 3 will be pressed by the feed roller 26 against the plate end abutment surface 63. The plate trailing end clamping bar 55 will now be closed and will clamp the trailing end 57 of the printing plate 60. The tensioning elements may now be activated to clamp the newly attached printing plate 60 on the plate cylinder 3.

As may be seen in FIG. 3, the plate end clamping position C is disposed by only a few degrees, such as 5°-10°, from the position A. This means that the plate cylinder 3 needs only be rotated a few degrees counter-clockwise from position A until it reaches the position C. In position C the feed roller 26 has bent the trailing end 57 of the printing plate 27 or 60 only slightly around an edge 61 of the groove 52 of the plate cylinder 3 so that the printing plate end 57 now lies on the clamping abutment surface 63 of the plate clamping and tensioning device 54. The trailing end 57 will now be within the periphery 62 of the plate cylinder 3 before it is clamped by the clamping bar 55. The feed roller 26 will then be moved back away out of contact with the printing plate 27 or 60 by actuation of the double acting cylinder 19 which will have been provided with a working medium in such a way that the piston rod 21 is pulled into the cylinder 19. This will swing the feed roller 26 away from the plate cylinder 3 around the axis 30 of the driving reel 29.

Referring now primarily to FIG. 5, there is shown schematically a control computer, generally at 66, which is connected to a plurality of electromagnetic valves 67. These valves 67, in turn, supply the various double-acting cylinders 19, 40, and 49 and the plate clamping and tensioning devices 53 and 54 with an operating medium from a pressure generator 72. The angular positions A, B, and C of the plate cylinder 3 are determined by a suitable rotational pulse emitter 71 which relays the angular positional information on to the control computer 66. All of the electric drives, such as the drive M for the plate cylinder 3, the drive for the press-on roller 33, and the like, are also controlled by the control computer 66. As will be discussed subsequently, the control computer 66 operates the various control valves and electric motors in the proper sequence, in conjunction with the position of the plate cylinder 3 in accordance with a suitable software program so that the printing plates 27 or 60 will be automatically fed to or fed from the plate cylinder 3.

Figure 6:
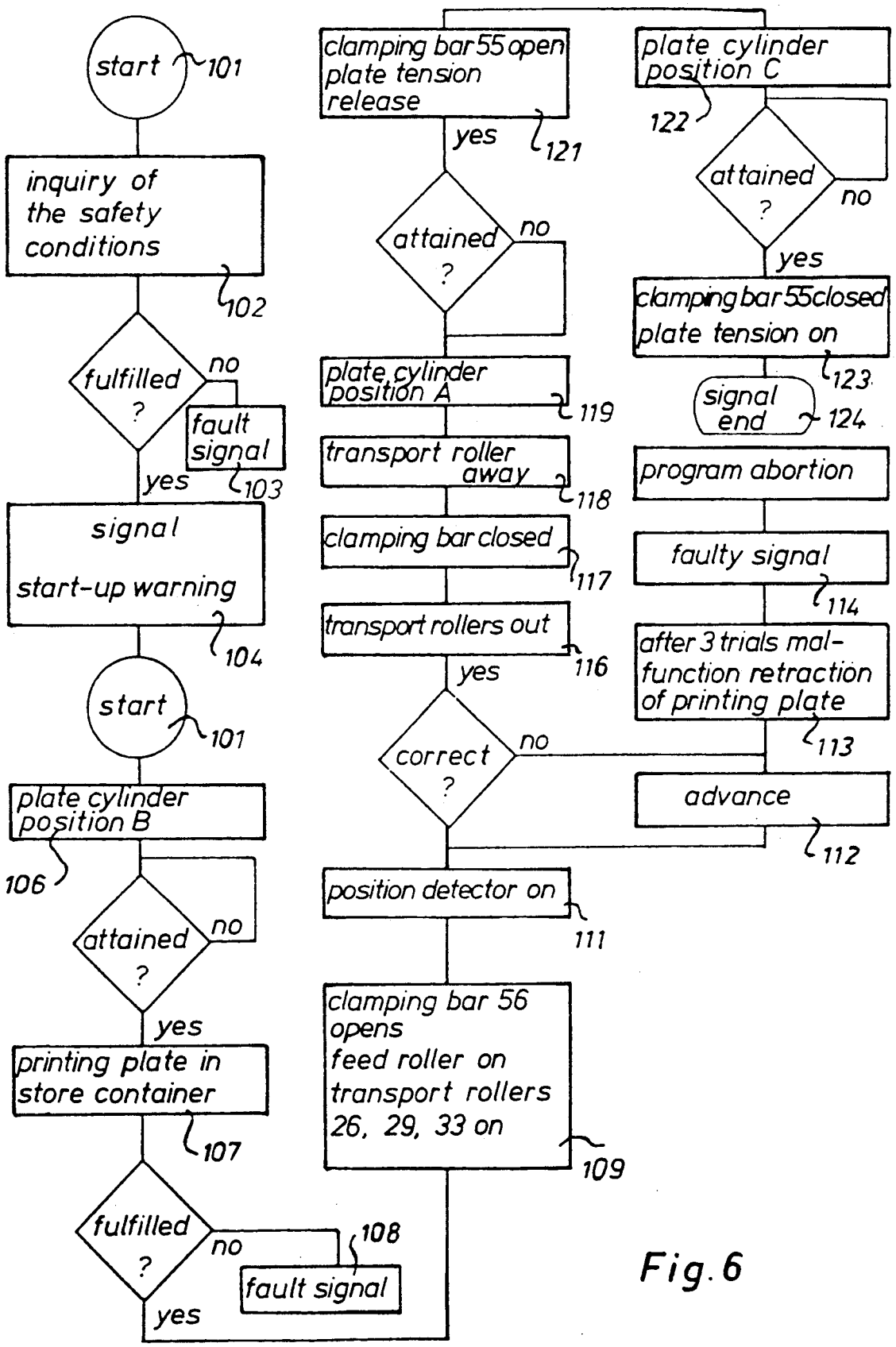
FIG. 6 is a logic flow chart for the feeding of a printing plate to the plate cylinder.

There is provided in FIG. 6 a logic flow diagram of the operation of the control computer 66 in its operation to automatically feed a printing plate 60 to the plate cylinder 3, as depicted in FIG. 1. As discussed above, the control computer 66 operates in conjunction with the various counters, such as rotational pulse emitter 71 and the position detector 59. Initially, a start switch or trigger 101 is manually or automatically activated. A series of safety inquiries, such as "Is the cover plate 11 closed?" are then implemented. If not all of the safety conditions have been implemented, a fault signal 103 will be produced. If all of the safety conditions have been fulfilled, a start-up warning signal 104 will be given. A second activation of the trigger 101 now activates the drive M for the plate cylinder 3 and moves the plate cylinder into the printing plate feeding in position B in step 106. Once the plate cylinder 3 has attained position B, the drive will be stopped.

A subsequent inquiry 107 concerns the existence of a new printing plate 60 in the printing plate feeding in or feeding out device 9. If the plate 60 is not present, sensors will signal that the new printing plate 60 is missing and a fault signal 108 will be produced. If the printing plate 60 is in place in the plate feeding in or feeding out device 9 in the next step 109 the clamping bar 56 will be opened, the feed roller 26 will be adjusted on the plate cylinder 3 and the drive for all the transport rollers 26, 29 and 33 will be activated. In the next step 111, the position detector 59 will be checked to be sure that the plate has engaged stops 51. If the position on the printing plate 60 is not correct at the stops 51, a further feed-in 112 of the printing plate will follow. After a negative information of three times 113, the transport rollers 26, 29 and 33 will be driven backwards, so that the printing plate 60 will be transported back into the storage container 39. A fault signal 114 will also be produced.

If the feeding of the printing plate 60 is correct, the drive for the transport rollers 26, 29 and 33 will be stopped in step 116. Thereupon the clamping bar 56 will be closed in step 117 and in step 118 the press-on roll 33 will be moved away from the driving reel 29. An activation 119 of the drive of the plate cylinder rotates the plate cylinder 3 into the plate cylinder position A. If the position is attained, the clamping bar 55 will be opened in step 121 and the plate tensioning device 54 is operated to remove any plate tension. In step 122, the plate cylinder 3 will be driven to plate cylinder position C. The plate cylinder 3 will not be stopped between the positions A and C. Upon attaining the plate cylinder position C, the clamping bar 55 will be closed in step 123 and thereupon the plate tensioning device 54 will be activated. After that, a signal "end" 124 will be produced. This completes the sequence of steps by which a printing plate 27 or 60 is advanced from the storage compartment 38 of the storage container of the printing plate feeding in or feeding out device 9.

Figure 7:
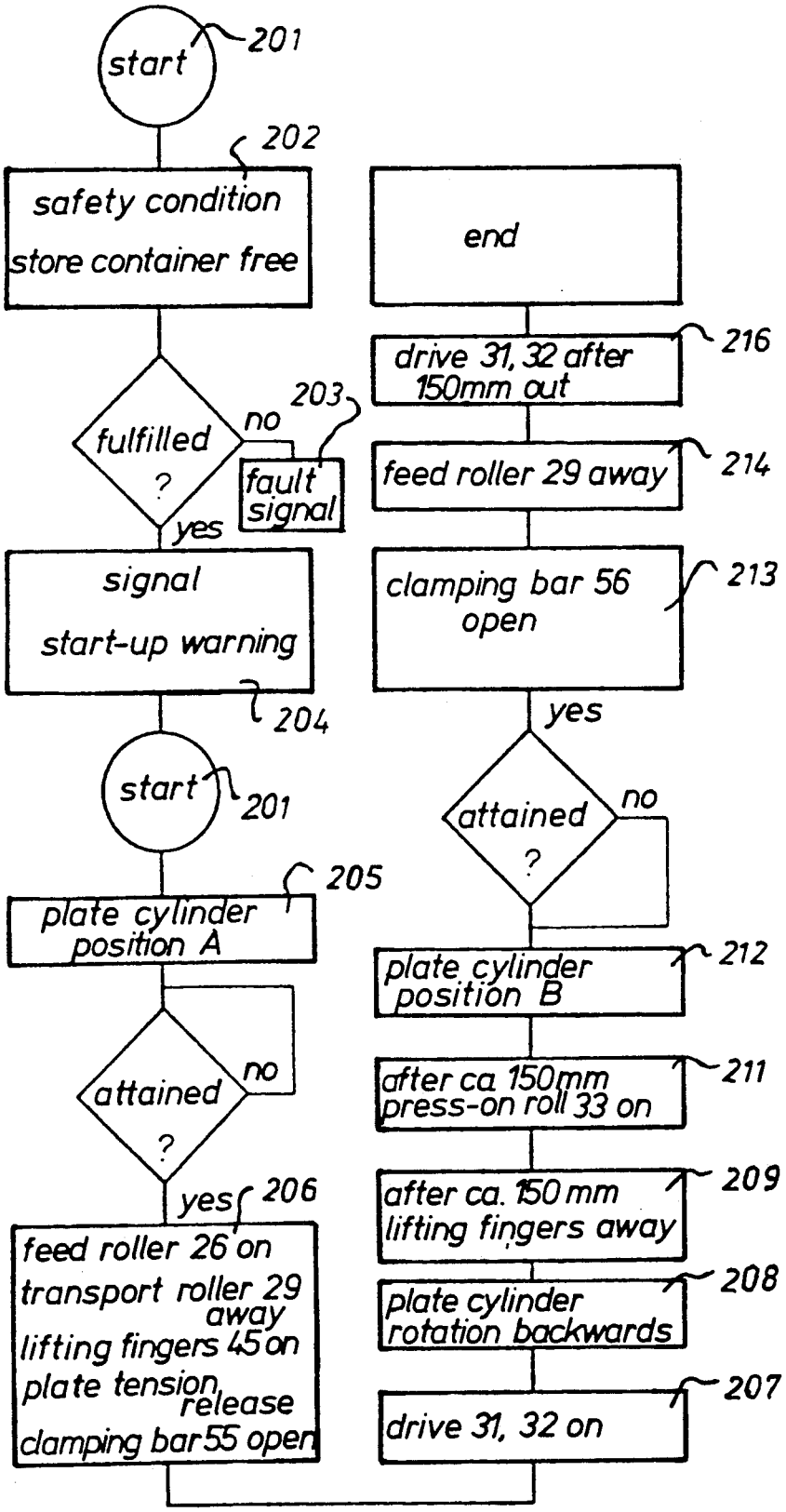
FIG. 7 is a logic flow chart for the feeding of a printing plate from the plate cylinder.

Turning now to FIG. 7, there is shown the logic diagram or flow chart for the operational steps which are followed by the control computer for the detachment and feeding out of a printing plate 27 from the plate cylinder 3 and for receipt of the plate in the printing plate storage container 38. By the actuation of a trigger 201, an inquiry 202 of the safety conditions, such as "Is the cover plate closed?" will be accomplished. Affiliated sensors will then be activated. An inquiry, whether the printing plate storage container 38 is empty, will also be effected. If these conditions are fulfilled, a start-up working signal 104 will be produced. By a second actuating of the trigger 201, the plate cylinder 3 is rotated by step 205 into the plate cylinder position A, Upon attainment of the plate cylinder position A, the feed roller 26 will be pressed onto the plate cylinder 3 by step 206. The press-on roll 33 will be moved away from the driving reel 29. The lifting fingers 45 will be activated and will move into the periphery 62 of the plate cylinder 3. The plate tension will be released and the clamping bar 55 will be opened.

In the next step 207, a drive 31 and 32 for the transport rollers 26 and 29 will be activated. Simultaneously, the drive for the plate cylinder 3 will be activated in step 208, so that it will rotate backwards. In the next step 209, after a plate cylinder rotation of about 50 mm radian measure out of the plate cylinder position A, the lifting fingers 45 will be swivelled out of the periphery 62 of the plate cylinder 3. In an ensuing step 211, the press-on roll 33 will be adjusted on the driving reel 29 after a plate cylinder rotation of about 150 millimeters radian measure out of the plate cylinder position A. Then, in step 212, the plate cylinder 3 goes to the plate cylinder position B. The clamping bar 56 will be opened in the following step 213. In step 214, the feed roller 26 will be put away. In the last step 216, the drives 31 and 32 for the transport rollers 29 and 33 will be stopped after a conveying distance of 150 millimeters radian measure starting from the plate cylinder position B. Thus the printing plate will be removed from the surface of the plate cylinder 3 and will be fed into and received in the plate storage compartment 39. It may then be manually removed from the compartment 39.

While a preferred embodiment of a method and apparatus for automatically feeding a printing plate in accordance with the present invention has been set forth fully and completely hereinabove, it will be apparent to one of skill in the art that a number of changes in, for example, the size of the plate cylinder and the printing plates, the specific types of valves and drive motors and the like may be made without departing from the true spirit and scope of the invention, which is accordingly to be limited only by the following claims.

What is claimed is:

1. An apparatus for automatically feeding in and receiving back a printing plate, said apparatus comprising:

a rotatable plate cylinder having a discontinuous peripheral surface including recessed areas;

a printing plate;

means for releasably carrying said printing plate on said peripheral surface of said plate cylinder;

a printing plate storage container positioned adjacent said plate cylinder and having an upper, generally vertical printing plate storage compartment and a curved front wall having a lower end positioned adjacent and generally tangential to said peripheral surface of said plate cylinder;

at least one movable lifting finger positioned between said peripheral surface of said plate cylinder and said lower end of said curved front wall;

means for moving said lifting finger into a selected one of said recessed areas and beneath said peripheral surface of said plate cylinder into engagement with an inner surface of a released end portion of said printing plate to elevate and separate said released end of said printing plate from said peripheral surface of said plate cylinder; and means to transport said separated printing plate between said storage compartment and said peripheral surface of said plate cylinder.

2. The apparatus of claim 1 wherein said means to transport said separated printing plate includes a plurality of transport rollers positioned intermediate said printing plate storage compartment and said plate cylinder.

3. The apparatus of claim 1 further including a plurality of spaced lifting fingers.

4. The apparatus of claim 1 further including a rotatable lifting finger shaft, said at least one movable lifting finger being attached to said lifting finger shaft.

5. The apparatus of claim 2 further including a press-on roll movably supported adjacent and selectively engageable with one of said transport rollers.

6. The apparatus of claim 5 further including automatically controllable adjusting elements for effecting said selective engagement of said press-on roll with said one of said transport rollers.

7. The apparatus of claim 1 further including a feed roller movably supported adjacent and selectively engageable with said plate cylinder.

8. The apparatus of claim 7 further including automatically controllable adjusting elements for effecting said selective engagement of said feed roller with said plate cylinder.

9. The apparatus of claim 1 including at least a first clamping bar on said plate cylinder, said clamping bar having a lifting finger receiving aperture and further including a lifting finger recess on said peripheral portion of said plate cylinder adjacent said clamping bar.

10. The apparatus of claim 1 wherein said printing plate storage container is formed having said upper printing plate storage compartment and said curved front wall being joined by a hinge.

11. A method for automatically feeding a printing plate from a plate cylinder including the steps of:

providing a plate cylinder having a discontinuous peripheral surface including recessed areas;

positioning a printing plate having leading and trailing ends on said peripheral surface;

providing means for releasably clamping said leading and trailing ends of said printing plate on said plate cylinder;

providing a printing plate storage container having an upper generally vertical printing plate storage compartment and a curved front wall having a lower end;

locating said printing plate storage container adjacent said plate cylinder with said lower end of said curved front wall being adjacent and generally tangential to said peripheral surface of said plate cylinder;

locating at least one movable lifting finger between said peripheral surface of said plate cylinder and said lower end of said curved wall;

rotating said plate cylinder in a first direction into a printing plate releasing position;

opening a first clamping bar of said clamping means and releasing said trailing end of said printing plate;

moving said lifting finger into a selected one of said recessed areas and beneath said peripheral surface of said plate cylinder and into engagement with an inner surface of said released trailing end of said printing plate;

rotating said plate cylinder in a second direction opposite to said first direction;

positioning said lifting finger between said released trailing end of said printing plate and said peripheral surface of said plate cylinder and separating said printing plate from said plate cylinder;

directing said trailing end of said printing plate into engagement with said curved wall;

continuing rotation of said plate cylinder in said second direction and guiding said separated printing plate into said storage container;

opening a second clamping bar of said clamping means and releasing said leading end of said printing plate; and transporting said printing plate completely into said printing plate storage container.

* * * * *